US007364826B2

(12) United States Patent
Fujii et al.

(10) Patent No.: US 7,364,826 B2
(45) Date of Patent: Apr. 29, 2008

(54) ELECTROSTATIC LATENT IMAGE DEVELOPING TONER, AND METHOD FOR MANUFACTURING ELECTROSTATIC LATENT IMAGE DEVELOPER AND ELECTROSTATIC LATENT IMAGE DEVELOPING TONER

(75) Inventors: Takahisa Fujii, Minamiashigara (JP); Hiroyoshi Okuno, Minamiashigara (JP); Shinichirou Kawashima, Minamiashigara (JP); Takeshi Iwanaga, Minamiashigara (JP); Toshiaki Hasegawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 10/902,818

(22) Filed: Aug. 2, 2004

(65) Prior Publication Data

US 2005/0181295 A1 Aug. 18, 2005

(30) Foreign Application Priority Data

Jan. 27, 2004 (JP) ..... 2004-017918

(51) Int. Cl.
*G03G 9/08* (2006.01)

(52) U.S. Cl. ..... 430/108.1; 430/109.3; 430/110.3; 430/137.1

(58) Field of Classification Search ..... 430/108.1, 430/109.3, 110.3, 137.1
See application file for complete search history.

(56) References Cited

U.S. PATENT DOCUMENTS

| | | | | |
|---|---|---|---|---|
| 6,226,488 | B1 * | 5/2001 | Maeyama | 399/322 |
| 6,929,893 | B2 | 8/2005 | Yoshino et al. | |
| 2003/0175611 | A1 * | 9/2003 | Fujii et al. | 430/124 |
| 2004/0058265 | A1 * | 3/2004 | Kawanishi et al. | 430/108.8 |

FOREIGN PATENT DOCUMENTS

| | | |
|---|---|---|
| JP | 49-91231 | 8/1974 |
| JP | A 56-40868 | 4/1981 |
| JP | A-07-271095 | 10/1995 |
| JP | A 10-207116 | 8/1998 |

* cited by examiner

*Primary Examiner*—John L Goodrow
(74) *Attorney, Agent, or Firm*—Oliff & Berridge, PLC

(57) ABSTRACT

There is provided an electrostatic latent image developing toner including a binder resin, a colorant, and a release agent, wherein the shape factor SF1 of the toner is within the range from 110 to 140, the volume average particle size of the toner is within the range from 1.2 μm to 4.8 μm, and the crystallinity of the release agent within the toner is within the range from 35 to 80. There is also provided a method for manufacturing such a toner.

19 Claims, No Drawings

ELECTROSTATIC LATENT IMAGE DEVELOPING TONER, AND METHOD FOR MANUFACTURING ELECTROSTATIC LATENT IMAGE DEVELOPER AND ELECTROSTATIC LATENT IMAGE DEVELOPING TONER

BACKGROUND OF THE INVENTION

1. Field of the Invention

The present invention relates to an electrostatic latent image developing toner used in a developer when developing an electrostatic latent image formed by a method such as xerography and electrostatic recording. The present invention also relates to a method for manufacturing an electrostatic latent image developer and electrostatic latent image developing toner.

2. Description of the Related Art

In xerography, an electrostatic latent image is formed on a photoreceptor by performing a charging process and an exposure process. The electrostatic latent image is subsequently visualized by performing a developing process using a developer including a toner, a transfer process, and a fixation process. The developer may be a two-component developer composed of a toner and a carrier, or a single-component developer in which a magnetic or non-magnetic toner is used alone. Toners are commonly fabricated using a kneading-and-grinding method in which a thermoplastic resin is melted and kneaded with a pigment, a charge control agent, and a release agent such as wax. The mixture is then cooled, finely ground, and classified.

When such a conventional method is used, the shapes of toner particles become non-uniform. Further, the surface structures of the toner particles vary depending on the grindability of materials used and the conditions of the grinding process. As such, it is very difficult to control the shapes and surface structures of toner particles as desired.

Recently, wet fabrication methods for manufacturing a xerographic toner have been proposed as methods which allow control of the shape and surface structure of toner particles as desired. Among such wet fabrication methods are a wet spherification method which permits shape control, a suspension granulation method which permits surface composition control, a suspension polymerization method which permits internal composition control, and an emulsion polymerization aggregation method.

By chemically forming the toner particles using these methods, toners having very small particle sizes such as a volume average particle size of 5 μm, which were practically impossible to produce using a conventional method, are now commercially available at low cost. Further, according to the conventional method, because the shapes of the toner particles are non-uniform, resulting in a wide distribution of particle sizes and therefore requiring an increased number of toner particles per unit area, charge control of small-particle toners produced by the conventional method is difficult to be performed. However, by using the wet fabrication method, the particle sizes and shapes can be made uniform, and charge control is facilitated. For these reasons, further enhancements in production of high-quality images are desired, and it is widely expected that small-particle toners produced by the wet fabrication method will realize these enhancements.

In xerography, there exist two different methods for preventing adhesion of toner onto a fixation roller used when fixing toner on a sheet such as paper. One method is to apply oil on a heat roll when performing the fixation, so as to provide release property between the heat roll and the image being fixed. According to this method, no release agent is included in the toner particles. The second method is an oil-less method, in which a release agent such as wax is included within the toner particles. During the fixation process, the release agent within the toner particles are made to migrate to the image surface by the heat of the heat roll, thereby achieving release property. The second oil-less method is advantageous over the first method because the second method overcomes the problem that a sheet processed with the first method does not practically accept thereon further writing with a ball-point pen or an ink or attachment of a label. However, the second method is still disadvantageous in that, because a release agent is present within a fixed image, light scattering results, which leads to degradations in transparency of an OHP film and color producing property.

A wet fabrication method for manufacturing a xerographic toner includes a heating step in which heat is applied to various materials of the toner particles (for example, in an emulsion polymerization aggregation method, this step corresponds to the fuse or coalesce step; in a suspension polymerization method, the polymerizing monomer polymerization step). Typically, after the heating step, the toner is cooled, then the surfaces of the toner particles are processed with an acid or base to provide charging property, fluidity, and storage stability to the particles. A problem specific to the wet fabrication method is that, during the cooling, the release agent precipitates onto the toner surface due to the volume reduction caused by a difference between the glass transition points (Tg) and/or melting points of the binder and the release agent.

In general, the volume of a material decreases when the material changes from liquid to solid phase, and volume of the solid material (without change of phase) decreases as the temperature is lowered. In a particle composed of a single component, such a volume reduction would occur uniformly within the overall particle. However, in a toner particle including a binder having a release agent mixed therein, when both the binder and the release agent have low crystallinity, the binder having Tg and melting point higher than those of the release agent would contract at a higher rate at the same temperature compared to the release agent. Due to this contraction stress of the binder, the release agent would precipitate from where the binder pressure becomes low. This disadvantageous phenomenon would occur more noticeably in small-particle toners having a smaller volume to surface area ratio.

Typically, an external additive is applied to the toner surface so as to provide charging property, fluidity, and transferability to the toner surface. Because the release agent has a hardness less than that of the binder, if the release agent is precipitated onto the toner surface, the external additive would become easily buried within the precipitated release agent upon application of a physical shock along with heat. As a result, the charging property of the toner particles may become unstable, and degradations in fluidity and transferability may be caused. Further, undesirable adhesion of the toner to device parts may occur, and, when a two-component developer is used, undesirable adhesion of the toner to carrier may occur.

In order to prevent precipitation of the release agent onto the toner surface, various measures have been devised. More specifically, attempts for that purpose have been made to reduce the amount of the added release agent, reduce the domain size of the release agent within the toner, and increase the thickness of the binder layer located on the surface of the toner.

For example, Japanese Patent Laid-Open Publication No. Hei 10-207116 discloses the control of the amount of release agent within the toner and on the toner surface. Further, this publication recites that, by controlling the dispersion diameter of the release agent within the toner, a toner which allows to create high-quality color images and OHP images having excellent transparency can be produced.

Although the above-noted measures are effective in preventing precipitation of the release agent onto the toner surface, those measures also have a negative influence on migration of the release agent to the fixed image surface during fixation and disadvantageously reduce glossiness of the fixed image surface. Furthermore, the separating ability of the heat roll surface from the developer may become degraded, which would cause a hot offset. As such, there exists a requirement for a new small-particle toner having controlled surface structure.

Further, according to the method described in Japanese Patent Laid-Open Publication No. Hei 10-207116, when the toner fabrication process includes a fuse or coalesce step using heat, a slow cooling step performed after the heating causes crystallization of the release agent. Accordingly, if this method is employed to produce a small-particle toner, the particle size cannot be controlled.

The present invention relates to a small-particle toner including a release agent, and provides an electrostatic latent image developing toner having stable charging property, fluidity, and storage stability, which allows to create a high-quality image having high transparency. The present invention also provides a method for manufacturing an electrostatic latent image developer and electrostatic latent image developing toner having such characteristics.

SUMMARY OF THE INVENTION (1) According to one aspect of the present invention, there is provided an electrostatic latent image developing toner including a binder resin, a colorant, and a release agent, wherein the shape factor SF1 of the toner is within the range from 110 to 140, the volume average particle size of the toner is within the range from 1.2 μm to 4.8 μm, and the crystallinity of the release agent within the toner is within the range from 35 to 80.

(2) According to another aspect of the present invention, there is provided an electrostatic latent image developer using an electrostatic latent image developing toner including a binder resin, a colorant, and a release agent, wherein the shape factor SF1 of the toner is within the range from 110 to 140, the volume average particle size of the toner is within the range from 1.2 μm to 4.8 μm, and the crystallinity of the release agent within the toner is within the range from 35 to 80.

(3) According to another aspect of the present invention, there is provided a method for manufacturing an electrostatic latent image developing toner including a binder resin, a colorant, and a release agent. The method comprises a process of granulating toner particles, including a step of heating to or above a glass transition temperature of the binder resin, and a step of cooling after the heating. The cooling step is performed by speedily cooling at a cooling rate of 10° C./minute or faster from the temperature of the heating step. The toner obtained as a result of the above process has the shape factor SF1 ranging from 110 to 140, and the volume average particle size ranging from 1.2 μm to 4.8 μm. The crystallinity of the release agent within the toner is within the range from 35 to 80.

DETAILED DESCRIPTION OF THE INVENTION

Embodiments of the present invention will next be described in detail.

(Electrostatic Latent Image Developing Toner)

An electrostatic latent image developing toner according to one embodiment of the present invention is an electrostatic latent image developing toner including a binder resin, a colorant, and a release agent, wherein the shape factor SF1 of the toner is within the range from 110 to 140, the volume average particle size of the toner is within the range from 1.2 μm to 4.8 μm, and the crystallinity of the release agent within the toner is within the range from 35 to 80.

According to one embodiment of the present invention, the toner is manufactured by a wet method including at least a cooling step. Volume changes in the binder resin and the release agent of the toner generated during the cooling step are controlled, so as to minimize precipitation of the release agent onto the toner surface, which tends to noticeably occur particularly in small-particle toners. In this manner, a toner having favorable charging property, fluidity, and transferability can be produced.

In an attempt to overcome the problems referenced above, the present inventors discovered that, by controlling the crystallinity of the release agent within a toner particle, it is possible to minimize precipitation of the release agent onto the toner surface generated during the cooling step of toner production. In addition, the present inventors determined that control of migration of the release agent to the image surface during image fixation is a significant factor in obtaining a toner having excellent fixation property along with favorable charging property, fluidity, and transferability.

According to the present embodiment, the toner may be manufactured by any of the following methods without limitation: a suspension polymerization method in which components such as a colorant and a release agent are suspended together with polymerizing monomers, and the polymerizing monomers are polymerized; a dissolution suspension method in which toner component materials such as a resin, a colorant, and a release agent are dissolved in an organic solvent, and, after the solution is dispersed in a suspended state within an aqueous solvent, the organic solvent is removed; and an emulsion polymerization aggregation method in which a resin prepared by emulsion polymerization is hetero-aggregated together with a dispersion liquid including components such as a pigment and a release agent, then a fuse or coalesce process is performed. It should be noted that the toner may also be manufactured by any other method as long as the method includes a cooling step. Among the methods described above, the emulsion polymerization aggregation method is preferred considering factors such as the toner particle size controllability, the narrow particle size distribution, the shape controllability, the narrow shape distribution, and the internal dispersion controllability.

When using a hetero-aggregation method such as an emulsion aggregation method to fabricate the electrostatic latent image developing toner according to the present embodiment, it is preferable to first prepare an aggregation particle dispersed liquid by mixing liquids such as a resin fine particle dispersed liquid, a colorant dispersed liquid, a release agent dispersed liquid, and an inorganic fine particle dispersed liquid. The aggregation particle dispersed liquid is subsequently heated to or above the glass transition temperature of the resin fine particles to thereby fuse and form the toner.

According to the present embodiment, the toner preferably has a spherical shape defined as below using shape factor SF1:

$$SF1=(ML^2/A)\cdot(\pi/4)\cdot 100 \quad \text{(Equation 1)}$$

wherein ML denotes the absolute maximum length of the toner particle, and A denotes the projected area of the toner particle.

The above-noted values can be typically obtained by analyzing, using an image analyzer, an image of the toner acquired employing a microscope or scanning electron microscope. The shape is considered closer to a sphere when SF1 approaches 100. As the SF1 value increases, the difference between the maximum and the minimum lengths of the particle becomes larger, denoting that the shape is oval.

The shape factor SF1 of the electrostatic latent image developing toner according to the present embodiment ranges from 110 to 140, considering image forming ability. SF1 is more preferably in the range from 115 to 135, and further preferably in the range from 115 to 130. Because high fluidity, charging property, and transferability are required in a small-particle toner, adhesion of an external additive to the toner particle surface must be uniform and unchanging even when the toner particles are agitated in the developing device, while the shape factor SF1 is maintained within the above-noted ranges. When SF1 is below 110, the contact area between the toner particles and/or the carrier and toner particles would become decreased, such that the pressure applied to the external additive in the contact portions may be increased. Consequently, the external additive would become easily buried in the toner surface, resulting in variances in the charged states among the toner particles, which may cause the problem of fogging during developing. SF1 exceeding 140 would generate not only difficulty in performing transfer, but also migration of the external additive to concave portions in the toner particles. This may cause degradation in fluidity.

The volume average particle size D50v of the electrostatic latent image developing toner according to the present embodiment ranges from 1.2 μm to 4.8 μm. D50v is preferably in the range from 2.0 μm to 4.5 μm, and more preferably in the range from 2.5 μm to 4.0 μm. It is undesirable when the volume average particle size D50v is below 1.2 μm, because the toner charging property would become insufficient, such that the toner may scatter to cause image fogging. Furthermore, it would become difficult to sufficiently clean off the toner which remains untransferred, and such insufficient cleaning may generate filming. On the other hand, even when the volume average particle size D50v exceeds 4.8 μm, the advantages of the present embodiment can still be achieved. However, use of a toner having such a large D50v value would result in an image resolution lower than that can be achieved using a small-particle toner, thereby obstructing production of high-definition images.

Another characteristic value which is used to control the toner image quality and the life of a developer is particle size distribution GSD. In the present embodiment, GSD is preferably no greater than 1.26, more preferably no greater than 1.24, and further preferably no greater than 1.22. A GSD exceeding 1.26 indicates that the particle size distribution is wide, including many excessively fine and/or coarse particles. An influence of excessively coarse particles is that image quality may become degraded, while an influence of excessively fine particles is that the amount of developed toner would decrease, resulting in a shorter developer life. Measurement of a toner particle size is described in detail below.

The crystallinity value (degree of crystallization) of the release agent within the toner, as referred to in the present specification, can be determined by an X-ray analysis method. The crystallinity of the electrostatic latent image developing toner according to the present embodiment ranges from 35 to 80. In order to simultaneously prevent precipitation of the release agent onto the toner surface and achieve toner fixation property, the crystallinity is preferably in the range from 40 to 75, and more preferably in the range from 50 to 70. When the crystallinity of the release agent is below 35, fusing of the release agent within a toner particle would not appropriately proceed during the toner particle fusing process, leading to small domain size. This may result in impairing transparency of the fixed image as described below, and also in reducing releasability of the image. When the crystallinity of the release agent exceeds 80, the fusing speed of the release agent would become too fast, leading to an exceedingly large domain diameter. This may result in magnifying the influence of the volume changes of the binder resin and the release agent during cooling, thereby causing precipitation of the release agent onto the toner surface. As described above, such precipitation may degrade charging property, fluidity, and transferability.

According to the present embodiment, when the domain average longitudinal diameter of the release agent within a toner particle is denoted by R, and the toner volume average particle size is denoted by D, R/D is preferably within the range from 0.2 to 0.6. The advantages of the present embodiment can be accomplished more effectively when R/D is more preferably within the range from 0.3 to 0.5. When R/D is below 0.2, the number of domains within one toner particle becomes increased. Further, because of such a small domain diameter, pressure generated due to a difference in melt viscosity between the release agent and the binder would not be appropriately applied to the release agent during the fixation process. As a result, the release agent would not be properly pushed out to the fixed toner image surface, leading to degradation in releasability. In addition, scattering of incident light may occur at an interface between the release agent remaining within the fixed image and the binder resin, which would undesirably reduce transparency. When R/D exceeds 0.6, a disruption due to physical stress would occur in the toner within the developing device, at an interface between the release agent and the binder. The release agent exposed as a result of the disruption may cause contamination within the developing device and charging instability.

Control of the domain diameter can be achieved by controlling the temperature or time of the fuse or coalesce process. The release agent particles tend to fuse easily when the temperature of the fuse or coalesce process is increased or the time of the fuse or coalesce process is made longer. In this manner, the domain diameter can be made larger. It should be noted that a domain diameter value as referred to herein is the average domain diameter of the release agent within 200 toner particles determined by observation of toner cross-sections using a transmission electron microscope.

As the resin (binder resin) used in the electrostatic latent image developing toner according to the present embodiment, thermoplastic resin may be employed. Examples of the binder resin include, without limitation, homopolymers or copolymers of styrenes (styrene resins) such as styrene, para-chloro styrene, and α-methyl styrene; homopolymers or copolymers of esters having a vinyl group (vinyl-based resins), such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of vinyl nitriles (vinyl-based resins) such as acrylonitrile and methacrylonitrile; vinyl ether homopolymers or copolymers (vinyl-based resins) such as vinyl m ethyl ether,vinyl ethyl ether and vinyl isobutyl ether; homopolymers or copolymers of vinyl ketones (vinyl-based resins) such as vinyl methyl ketone, vinyl ethyl ketone, and vinyl isopropenyl ketone; homopolymers or copolymers of olephins (olephin-based resins) such as ethylene, propylene, butadiene, and isoprene; non-vinyl condensed resins such as epoxy resin, polyester resin, polyurethane resin, polyamide resin, cellulose resin, and polyether resin; and graft polymers of these non-vinyl condensed resins and vinyl-based monomers. These resins may be employed alone, or two or more of these resins may be used in combination.

Among the above-noted resins, vinyl-based resins are particularly preferred. Vinyl-based resins are advantageous in that a resin dispersed liquid using those resins can be prepared easily by emulsion polymerization, seed polymerization, or the like using an ion surfactant. Specific examples from among the above-noted vinyl-based polymerizing monomers include homopolymers or copolymers of styrenes such as styrene, para-chloro styrene, and α-methyl styrene; homopolymers or copolymers of esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of vinyl nitriles such as acrylonitrile and methacrylonitrile; vinyl ether homopolymers or copolymers such as vinyl methyl ether,vinyl ethyl ether and vinyl isobutyl ether; homopolymers or copolymers of vinyl ketones such as vinyl methyl ketone, vinyl ethyl ketone, and vinyl isopropenyl ketone; and homopolymers or copolymers of olephins such as ethylene, propylene, butadiene, and isoprene.

According to the present embodiment, a cross-linker maybe added to the binder resin in accordance with necessity. Examples of the cross-linker include, without limitation, aromatic polyvinyl compounds such as divinylbenzene and divinyl naphthalene; polyvinyl esters of aromatic multivalent carboxylate, such as divinyl phthalate, divinyl isophthalate, divinyl telephthalate, divinyl homophthalate, divinyl/trivinyl trimesate, divinyl(naphthalene dicarboxylate), and divinyl(biphenyl carboxylate); divinyl esters of nitrogen-containing aromatic compounds such as divinyl (pyridine dicarboxylate); vinyl esters of unsaturated heterocyclic compound carboxylate such as vinyl pyromucate, vinyl(furan carboxylate), pyrrole-2-vinylcarboxylate, and vinyl(thiophene carboxylate); acrylic or metacrylic esters of normal-chain polyalcohol, such as butanediol methacrylate, hexanediol acrylate, octanediol methacrylate, decanediol methacrylate, and dodecanediol methacrylate; acrylic or methacrylic esters of branched or substituted polyalcohol, such as neopentylglycol dimethacrylate and 2-hydroxy-1,3-diacryloxypropane; polyethyleneglycol diacrylates or dimethacrylates, and polypropylenepolyethyleneglycol diacrylates or dimethacrylates; and polyvinyl esters of multivalent carboxylate, such as divinyl succinate, divinyl fumarate, vinyl/divinyl maleate, divinyl diglycolate, vinyl/divinyl itaconate, divinyl(acetone dicarboxylate), divinyl glutarate, 3,3'-divinyl thiodipropionate, trans-divinyl/trivinyl aconitate, divinyl adipate, divinyl pimelate, divinyl suberate, divinyl azelate, divinyl sebacate, divinyl(dodecandionic acid), and divinyl brassylate.

In the present embodiment, these cross-linkers may be employed alone, or two or more of these cross-linkers maybe used in combination. In order to avoid increasing viscosity of the binder resin in the coalesced state to a level higher than required, it is preferable to select, as the cross-linker for the present embodiment, a cross-linker which allows to suppress precipitation of the release agent onto the toner surface during cooling. More specifically, it is preferable to select, from among the above cross-linkers, acrylic or methacrylic esters of normal-chain polyalcohol, such as butanediol methacrylate, hexanediol acrylate, octanediol methacrylate, decanediol acrylate, and dodecanediol methacrylate; acrylic or methacrylic esters of branched or substituted polyalcohol, such as neopentylglycol dimethacrylate and 2-hydroxy-1,3-diacryloxypropane; and polyethyleneglycol diacrylates or dimethacrylates, and polypropylenepolyethyleneglycol diacrylates or dimethacrylates.

The cross-linker content is preferably within the range from 0.05 to 5.0 wt % of the total amount of the polymerizing monomers, and more preferably within the range from 0.1 to 1.0 wt %.

The resin used for the toner of the present embodiment can be prepared by performing radical polymerization of the polymerizing monomers. There exist no particular limitations concerning the radical polymerization initiator used for this purpose. Examples of the radical polymerization initiator include, without limitation, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetrahydrin peroxide, 1-phenyl-2-methylpropyl-1-hydroperoxide, tert-butyl triphenylperacetate, tert-butyl performate, tert-butyl peracetate, tert-butyl perbenzoate, tert-butyl phenylperacetate, tert-butyl methoxyperacetate, and tert-butyl (N-(3-toluyl)percarbamate; azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutylonitrile, 2,2'-azobis-methyl(2-methylpropionate), 2,2'-dichloro-2,2'-azobisbutane, 2,2'-azobis-2-methylbutylonitrile, 2,2'-azobisiso (dimethylbutyrate), 1,1'-azobis(1-methylbutylonitrile-3-sodiumsulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, 4,4'-azobis-dimethyl(4-cyanovalerate), 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl(4-nitrophenylazobenzylcyanoacetate), phenylazodiphenylmethane, phenylazotriphenylmethane, 4-nitrophenylazotriphenylmethane, 1,1'-azobis-1,2-diphenylethane, poly((bisphenol A)-4,4'-azobis-4-cyanopentanoate), and poly(tetraethyleneglycol-2,2'-azobisisobutylate); 1,4-bis(pentaethylene)-2-tetrazene; and 1,4-dimethoxycarbonyl-1,4-diphenyl-2-tetrazene.

Control of the molecular weight of the resin used in the toner of the present embodiment can be performed using a chain transfer agent. There exist no limitations concerning the chain transfer agent used for this purpose, but it is preferable to use a substance having a covalent bond between a carbon atom and a sulfur atom. More specifically, the preferred chain transfer agents include n-alkyl mercaptans such as n-propyl mercaptan, n-butyl mercaptan, n-amyl mercaptan, n-hexyl mercaptan, n-heptyl mercaptan, n-octyl mercaptan, n-nonyl mercaptan, and n-decyl mercaptan; branched or cyclic alkyl mercaptans such as isopropyl mercaptan, isobutyl mercaptan, s-butyl mercaptan, tert-butyl mercaptan, cyclohexyl mercaptan, tert-hexadecyl mercaptan, tert-lauryl mercaptan, tert-nonyl mercaptan, tert-octyl mercaptan, and tert-tetradecyl mercaptan; and mercaptans containing an aromatic ring, such as allyl mercaptan, 3-phenylpropyl mercaptan, phenyl mercaptan, and mercaptotriphenylmethane.

The glass transition temperature of the binder resin used in the present embodiment is preferably in the range from 40° C. to 70° C., and more preferably in the range from 45° C. to 60° C.. When the glass transition temperature is below 40° C., the toner powder tends to form blocks under heat. When the glass transition temperature exceeds 70° C., the fixation temperature may become too high.

According to the present embodiment, weight average molecular weight Mw of the binder resin is preferably within the range from 6000 to 45000. When the binder resin is a polyester-based resin, Mw value of the binder resin is preferably in the range from 6000 to 10000. When the binder resin is a vinyl-based resin, the Mw value is preferably in the range from 24000 to 36000. When the weight average molecular weight Mw is greater than 45000, viscoelasticity during fixation would become too high, which would make it difficult to produce a smooth fixed image surface required for achieving high glossiness. When the Mw value is below 6000, the toner melt viscosity during the fixation process would be too low, lacking in sufficient cohesiveness and therefore possibly causing hot offset. Furthermore, when the binder resin is a polyester-based resin, an Mw value exceeding 10000 would result in difficulty in dispersing the resin within an aqueous medium.

According to the present embodiment, ratio Mw/Mn of weight average molecular weight Mw to number average molecular weight Mn of the binder resin is preferably no greater than 3.3, and more preferably no greater than 2.8. In order to achieve speedy migration of the release agent to the fixed image surface and to obtain a smooth fixed image surface, moderately low viscosity is advantageous, and a narrow molecular weight distribution is preferred. When Mw/Mn is greater than 3.3, it may be difficult to produce a smooth fixed image surface required for achieving high glossiness.

Examples of the colorant to be used in the toner of the present embodiment include, without limitation, various pigments such as carbon black, chrome yellow, Hansa yellow, benzidine yellow, indanthrene yellow, quinoline yellow, permanent orange GTR, pyrazolone orange, Vulcan orange, Watchung red, permanent red, brilliant carmine 3B, brilliant carmine 6B, dupont oil red, pyrazolone red, lithol red, rhodamine B lake, lake red C, rose bengal, aniline blue, ultra marine blue, charcoal blue, methylene blue chloride, phthalocyanine blue, phthalocyanine green, and malachite green oxalate; and various dyes such as acridine-based dye, xanthane-based dye, azo-based dye, benzoquinone-based dye, azine-based dye, anthraquinone-based dye, dioxazine-based dye, thiazine-based dye, azomethine-based dye, indigo-based dye, thioindigo-based dye, phthalocyanine-based dye, aniline black-based dye, polymethine-based dye, triphenyl methane-based dye, diphenyl methane-based dye, thiazole-based dye, and xanthene-based dye. These colorants can either be used as a single entity or as a combination.

In general, it is preferable to use, for the release agent to be used in the toner of the present embodiment, a substance having low compatibility with the binder resin of the toner. When a release agent having high compatibility with the binder resin is used, the release agent would dissolve into the binder resin to promote plasticization of the binder resin. This would lead to lower viscosity of the toner during the high-temperature fixation process, which would possibly cause offset.

The release agent is not particularly limited, as long as the resulting toner after the aggregation, fusing, and coalescing processes have the crystallinity value ranging from 35 to 80. Examples of the release agent include, without limitation, low molecular weight polyolephins such as polyethylene, polypropylene, and polybutene; silicones which exhibit a softening point when heated; fatty acid amides which exhibit a softening point when heated, such as oleamide, erucamide, ricinoleamide, and stearamide; plant-based wax which exhibit a softening point when heated, such as carnauba wax, rice wax, candelilla wax, sumacs wax, and jojoba oil; animal-based wax which exhibit a softening point when heated, such as beeswax; mineral-based wax and petroleum-based wax which exhibit a softening point when heated, such as montan wax, ozokerite, ceresin, paraffin wax, microcrystalline wax, and Fischer-Tropsh wax; ester wax obtained from higher fatty acid and higher alcohol, which exhibits a softening point when heated, such as stearyl stearate and behenyl behenate; ester waxes obtained from higher fatty acid and monovalent or multivalent lower alcohol, which exhibit a softening point when heated, such as butyl stearate, propyl oleate, glyceride monostearate, glyceride distearate, and pentaerythritol tetra behenate; ester waxes obtained from higher fatty acid and multivalent alcohol multimers, which exhibit a softening point when heated, such as diethyleneglycol monostearate, dipropyleneglycol distearate, diglyceryl distearate, and triglyceryl tetrastearate; sorbitan higher fatty acid ester waxes which exhibit a softening point when heated, such as sorbitan monostearate, and cholesterol higher fatty acid ester waxes which exhibit a softening point when heated, such as cholesteryl stearate.

The release agent content within the toner is preferably within the range from 6 to 25 wt % of the toner weight, and more preferably within the range from 9 to 20 wt %. When the release agent content within the toner falls below 6wt %, the absolute amount of the release agent would be insufficient, possibly generating document offset in which a fixed image migrates, by heat or pressure, to a sheet or image which contacts the fixed image. When the release agent content within the toner exceeds 25 wt %, viscoelasticity of the melted toner during the fixation process would decrease drastically, leading to hot offset. Furthermore, in the case of an OHP film, because the release agent would not penetrate into the film, the release agent would adhere to the fixation roll, causing a phenomenon referred to as wax offset, in which the release agent remaining on the fixation roll would contaminate other OHP films subsequently processed by the fixation roll.

In the toner of the preferred embodiment, a surfactant is preferably used to disperse resin particles, colorant particles, release agent particles, and the like to prepare resin particle dispersed liquid, colorant particle dispersed liquid, release agent particle dispersed liquid, and the like. As the surfactant, it is possible to use any of anionic surfactants, cationic surfactants, and non-ionic surfactants, which are described later in detail. However, anionic surfactants are generally preferred because of the high dispersion power in dispersing resin particles, colorants, release agents, and the like. While the surfactants can either be used as a single entity or as a combination, non-ionic surfactants are preferably used in combination with an anionic or cationic surfactant.

With the present embodiment, fine particles such as internal additives, charge control agents, inorganic fine particles, organic fine particles, lubricants, and polishing agents can be used in accordance with necessity, in addition to the above-described binder resins, colorants, and release agents.

Examples of internal additives include magnetic substances composed of metals such as ferrite, magnetite, reduced iron, cobalt, manganese, and nickel; alloys thereof; and compounds containing those metals.

Examples of inorganic fine particles include substances such as silica, titania, calcium carbonate, magnesium carbonate, tricalcium phosphate, and cerium oxide, which are typical external additives applied to the toner surface. Further, examples of the organic particles include substances such as vinyl-based resins, polyester-based resins, and silicone-based resins, which are also typical external additives applied to the toner surface. These inorganic and organic particles can be employed as fluidity auxiliaries, cleaning auxiliaries, or the like.

Examples of lubricants include fatty acid amides such as ethylene bis-stearamide and oleamide; and fatty acid metal salts such as zinc stearate and calcium stearate.

Examples of polishing agents include silica, alumina, and cerium oxide.

Although the above-described fine particles can be added in any appropriate amount within a range which does not obstruct the advantages achieved by the present embodiment, these fine particles are generally added in very small amounts. Specifically, the amount of the fine particles is preferably within the range from 0.01 to 5 wt % of the toner, and more preferably within the range from 0.01 to 3 wt %.

According to the present embodiment, in order to improve fluidity, various resin powders and inorganic compounds can be added to the toner particle surface in the form of external additive. As the resin powders for this purpose, spherical particles of substances such as PMMA, nylon, melamine, benzoguanamine, and fluorine-based resins can be used. Examples of various conventional inorganic compounds for this purpose include, without limitation, $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, CaO. $SiO_2$, $CaCO_3$, $K_2O(TiO_2)_n$, $MgCO_3$, $Al_2O_3.2SiO_2$, $BaSO_4$, and $MgSO_4$. Among these, $SiO_2$, $TiO_2$, and $Al_2O_3$ are preferred. These inorganic compounds may either be used as a single entity or as a combination. The particle size of the external additive is preferably no greater than 0.1 μm. The added amount of the external additive can range from 0.1 to 20 wt % of the toner particle.

The electrostatic latent image developing toner according to the present embodiment is preferably manufactured using a method including a toner particle granulating process. The granulating process includes a step of heating to or above the glass transition temperature (Tg) of the binder resin, and a cooling step after the heating. The cooling step is preferably performed by speedily cooling at a cooling rate of 10° C./minute or faster from the temperature of the heating step.

In an electrostatic latent image developing toner according to the present embodiment, the crystallinity of the release agent within the toner is controlled. Accordingly, even when the toner is formed to have small particle size so as to achieve image quality enhancements, the toner allows to accomplish high OHP transparency and long-term image stability. The toner has stable charging property, fluidity, and storage stability.

(Method for Manufacturing Electrostatic Latent Image Developing Toner)

A method for manufacturing an electrostatic latent image developing toner according to the present embodiment includes a toner particle granulating process. The granulating process includes a step of heating to or above the glass transition temperature (Tg) of the binder resin, and a cooling step after the heating. The cooling step is performed by speedily cooling at a cooling rate of 10° C./minute or faster from the temperature of the heating step.

The electrostatic latent image developing toner according to the present embodiment is preferably manufactured by a wet fabrication method, in which a binding resin dispersed liquid, a colorant dispersed liquid, a release agent dispersed liquid, and the like are aggregated and granulated within water, an organic solvent, or a solvent composed of a mixture thereof, so as to form colored resin particles, and the colored resin particles are washed and dried to obtain toner particles.

When granulating the colored resin particles, the materials are heated to or above the Tg of the binder resin. The heating temperature is preferably a value that is 1.6 times greater than Tg or higher. When the heat fuse temperature is below 1.6 times Tg, fusing may not occur sufficiently. Concerning the upper limit, the heat fuse temperature is preferably below a value 2.5 times greater than Tg. A heat fuse temperature exceeding 2.5 times Tg is undesirable because the colored resin particles may excessively aggregate with one another.

The cooling step is preferably performed after the heating of the colored resin particles by speedily cooling at a cooling rate of 10° C./minute or faster. This cooling at the cooling rate of 10° C./minute or faster is preferably performed to a temperature below a value that is 1.4 times greater than the Tg of the binder resin. If the cooling at the cooling rate of 10° C./minute or faster is not performed to a temperature below a value that is 1.4 times the Tg of the binder resin, the binder resin would not be sufficiently cured, such that the release agent would tend to precipitate onto the toner surface due to the volume changes of the binder resin and the release agent. In addition, the toner shapes may change easily. During the cooling step, the cooling is more preferably performed to a temperature below a value that is 1.2 times greater than the Tg of the binder resin, and further preferably to a temperature below Tg.

In order to sufficiently accomplish the advantages of the present embodiment, the cooling rate is preferably 15° C./minute or faster, and more preferably 20° C./minute or faster. Faster cooling rates are generally more preferred. The cooling rate may be changed depending on the scale of toner fabrication. For example, on the scale of a prototype facility (approximately from 5000L to 80000L), the cooling rate may range from 20° C. to 50° C./minute, while the cooling rate may range from 50° C. to 70° C./minute according to a small laboratory-level scale (up to 1000L).

Generally, when particles are in a dispersed state, pressure would be applied to the particles by the dispersant medium. At a temperature sufficiently higher than the Tg of the binder resin and the melting point of the release agent, such as the coalesce temperature, the toner particles would be maintained in a melted state while their particle sizes would be simultaneously maintained by the external pressure applied to the particles. The release agent, in order function effectively, preferably has a melting point higher than the Tg of the binder resin such that the release agent starts to solidify before the binder resin during cooling. As noted above, volume reduction would occur in a liquid and a solid along with a temperature decrease. Variances in volume reduction may result depending on the crystallinity of the material. The release agent typically would have high crystallinity so that its molecules tend to align. After alignment of molecules, volume change would less likely occur, even when the temperature decreases. The release agent therefore would contract at a rate lower than the binder resin having low crystallinity, resulting in a smaller volume change in the release agent compared to the binder resin. When the cooling rate is slow, the cooling process would continue after the release agent has already solidified within a certain temperature range during an initial stage of the cooling process. During a subsequent stage of the cooling process, the binder resin having low crystallinity would contract at a much higher rate compared to the solidified release agent. As a result, the toner particles tend to become deformed. Furthermore, because the external pressure applied to the toner particles would become non-uniform due to deformation, the release agent solidified within the toner particles would become migrated easily, leading to precipitation onto the toner surface. In small-particle toners having smaller volume to surface area ratio, this phenomenon tends to be more noticeable, resulting in toner shape deformation and exposure of the release agent onto the toner surface. In order to avoid these disadvantages, it is preferable to speedily cool the binder resin and the release agent together so as to shorten as much as possible the time during which the release agent solidification and the binder resin curing occur. For this reason, the above-noted cooling conditions are preferred.

The method for cooling is not limited as long as the desired cooling rate can be achieved in the fabrication tank. However, it may be preferable to employ the method of introducing the solvent used for granulation or a solvent that does hot influence the granulated toner, which may be water or an alcohol such as ethyl alcohol or butyl alcohol. In order to enhance the cooling effect, the temperature of the solvent (such as water or alcohol) is preferably cooled to or below 15° C., and more preferably to or below 10° C. In order to further enhance the cooling effect, the solvent in solidified form, such as ice, may be preferably used. The solidified substance (such as ice) may be introduced alone, or a mixture of the solidified substance and the solvent (such as ice and cold water) may be used. The desired cooling rate may also be achieved by introducing a liquid or solid form of a substance that is in gas phase at room temperatures, such as liquid nitrogen or dry ice. The amount of the above-noted liquids or solids to be introduced can be determined according to the scale of the toner granulation process or the like.

Instead of introducing the liquids or solids as described above, rapid cooling can alternatively be achieved by providing in the fabrication system a cooling rod or a similar structure having a coolant circulated inside. Although it may be possible to perform the cooling by a typical method of using a cooling jacket, such may be rather impractical when the toner production scale is large because the volume to surface area ratio would be accordingly large.

By using a cooling rod or a similar structure, the cooling surface area can be increased, allowing to accomplish effective cooling. Various cooling methods, such as the introduction of the above-noted liquids or solids, use of a cooling rod, and use of a cooling jacket, may be used in combination.

According to the toner manufacturing method of the present embodiment, it is particularly preferable to employ an emulsion polymerization aggregation method, in which a resin is dispersed by emulsion polymerization or other approaches to prepare a resin dispersed liquid, the resin is hetero-aggregated together with dispersion liquids including components such as a pigment and a release agent, then a fuse or coalesce process is performed. The emulsion polymerization aggregation method includes mixing a resin dispersed liquid, which contains resin particles having the particle size of 1 μm or smaller, with other dispersion liquids such as a colorant dispersed liquid containing a colorant dispersed therein, and allowing the resin particles and the colorant to aggregate to an appropriate toner particle size (this stage of the method may be referred to as the aggregating process). The emulsion polymerization aggregation method further includes a step of heating the obtained material to or above the glass transition temperature of the resin particles to fuse the aggregates to thereby form toner particles (this stage may be referred to as the fusing process).

As another embodiment of a method for manufacturing an electrostatic latent image developing toner according to the present embodiment, a suspension polymerization method can also be used favorably. According to the suspension polymerization method, particles such as colorant particles and release agent particles are suspended together with polymerizing monomers within an aqueous medium having a dispersion stabilizer added therein according to necessity, so as to allow the particles to disperse to a desired particle size and particle size distribution. The polymerizing monomers are subsequently polymerized by heating or the like. The polymerized product is then removed from the aqueous medium, and washed and dried according to necessity to form toner particles.

Examples of the resin (binder resin) to be used in the above-noted resin fine particle dispersed liquid include the same resins as those referred to in the above description of the electrostatic latent image developing toner of the present embodiment. Further, the above-described cross-linkers may also be added to the binder resin according to necessity.

According to the toner manufacturing method of the present embodiment, a surfactant is preferably used to disperse resin particles, colorant particles, release agent particles, and the like to prepare the resin particle dispersed liquid, colorant particle dispersed liquid, release agent particle dispersed liquid, and the like. As the surfactant, it is possible to use any of anionic surfactants, cationic surfactants, and non-ionic surfactants, which are described later in detail. However, anionic surfactants are generally preferred because of the high dispersion power in dispersing resin particles, colorants, release agents, and the like. While the surfactants can either be used as a single entity or as a combination, non-ionic surfactants are preferably used in combination with an anionic or cationic surfactant.

Examples of anionic surfactants include, without limitation, fatty acid soaps such as potassium laurate, sodium oleate, and castor oil sodium; sulfate esters such as octyl sulfate, lauryl sulfate, laurylether sulfate, and nonylphenylether sulphate; sodium alkylnaphthalenesulfonates such as lauryl sulfonate, dodecylbenzene sulfonate, triisopropylnaphthalene sulfonate, and dibutylnaphthalene sulfonate; sulfonate salts such as naphthalene sulfonate-formalin condensate, monooctyl sulfosuccinate, dioctyl sulfosuccinate, lauramide sulfonate, and oleamide sulfonate; phosphate esters such as lauryl phosphate, isopropyl phosphate, and nonylphenylether phosphate; dialkylsulfosuccinate salts such as sodium dioctylsulfosuccinate; and sulfosuccinate salts such as disodium lauryl sulfosuccinate.

Examples of cationic surfactants include, without limitation, amine salts such as laurylamine hydrochloride, stearylamine hydrochloride, oleylamine acetate, stearylamine acetate, and stearylaminopropylamine acetate; and quaternary ammonium salts such as lauryl-trimethyl ammonium chloride, dilauryl-dimethyl ammonium chloride, distearyl-dimethyl ammonium chloride, lauryl-dihydroxy-ethyl-methyl ammonium chloride, oleyl-bis(polyoxyethylene)-methyl ammonium chloride, lauroyl-aminopropyl-dimethyl-ethyl ammonium ethosulfate, lauroyl-aminopropyl-dimethyl-hydroxy-ethyl ammonium perchlorate, alkylbenzene-trimethyl ammonium chloride, and alkyl-trimethyl ammonium chloride.

Examples of non-ionic surfactants include, without limitation, alkyl ethers such as polyoxyethylene octyl ether, polyoxyethylene lauryl ether, polyoxyethylene stearyl ether, and polyoxyethylene oleyl ether; alkyl pheyl ethers such as polyoxyethylene octyl phenyl ether and polyoxyethylene nonyl phenyl ether; alkyl esters such as polyoxyethylene laurate, polyoxyethylene stearate, and polyoxyethylene oleate; alkyl amines such as polyoxyethylene lauryl aminoether, polyoxyethylene stearyl aminoether, polyoxyethylene oleyl aminoether, polyoxyethylene soy aminoether, and polyoxyethylene tallow aminoether; alkylamides such as polyoxyethylene lauramide, polyoxyethylene stearamide, and polyoxyethylene oleamide; vegetable oil ethers such as polyoxyethylene castor oil ether and polyoxyethylene rapeseed oil ether; alkanol amides such as diethanolamide laurate, diethanolamide stearate, and diethanolamide oleate; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The surfactant content within each dispersion liquid can be at any level as long as the advantages of the present embodiment are not obstructed, but is generally small. The surfactant content is preferably within the range approximately from 0.01 to 10 wt %, more preferably within the range approximately from 0.05 to 5 wt %, and further preferably within the range approximately from 0.1 to 2 wt %. When the surfactant content is below 0.01 wt %, each of the resin particle dispersed liquid, colorant dispersed liquid, release agent dispersed liquid, and the like may become unstable, leading to aggregation of each types of particles. Furthermore, due to differences between dispersion stabilities among particle types, a specific type of particle may become disengaged during the aggregation process. A surfactant content exceeding 10 wt % may result in a wide particle size distribution and difficulty in controlling the particle size. In general, when the particle size of the dispersed material is large, the dispersed liquid can be stabilized using only a small amount of surfactant.

As the dispersion stabilizer to be used in the preferred toner manufacturing method, an inorganic fine powder which is water-insoluble and hydrophilic may be selected. Examples of the inorganic fine powders include, without limitation, silica, alumina, titania, calcium carbonate, magnesium carbonate, tricalcium phosphate (hydroxyapatite), clay, diatomaceous earth, and bentonite. Among these examples, calcium carbonate and tricalcium phosphate are preferred because these substances facilitate formation of fine particles and are easily removable.

Moreover, an aqueous polymer which is solid at room temperatures may also be used for the surfactant. Examples of the aqueous polymer includes, without limitation, cellulose-based compounds such as carboxy methyl cellulose and hydroxyl propyl cellulose; polyvinyl alcohol, gelatin, starch, and gum arabic.

The average particle size of the resin particles within the resin particle dispersed liquid is preferably no greater than 1 μm, and more preferably within the range from 0.01 μm to 1 μm. When the average resin particle size exceeds 1 μm, toner performance and reliability may become degraded because the particle size distribution of the toner particles obtained after aggregation and fusing may become wide, and, in addition, free particles may be generated in the toner. In the preferred toner manufacturing method, by controlling the average resin particle size within the above-noted range, the resin fine particles can be favorably dispersed within the aggregate particles, preventing maldistribution of components among the individual toner particles. In this manner, variances intoner performance and reliability can be advantageously minimized. It should be noted that the average particle size can be measured using, for example, a laser diffraction type particle size distribution analyzer or a Coulter counter.

As the colorant to be used in the preferred toner manufacturing method, the same colorants as described above may be employed.

The average particle size of the colorant within the colorant dispersed liquid is preferably no greater than 1 μm, more preferably no greater than 0.5 μm, and further preferably within the range from 0.1 μm to 0.5 μm. When the average colorant particle size exceeds 1 μm, toner performance and reliability may become degraded because the particle size distribution of the resulting electrostatic latent image developing toner particles may become wide, and, in addition, free particles may be generated in the toner.

In the present toner manufacturing method, by controlling the average colorant particle size within the above-noted range, the colorant can be dispersed favorably within the aggregated particles, preventing maldistribution of components among the individual toner particles. In this manner, variances in toner performance and reliability can be advantageously minimized. By further controlling the average colorant particle size to a value no greater than 0.5 μm, further enhancements can be made in the coloring property, color reproducibility, and OHP transparency of the toner. It should be noted that the average particle size can be measured using, for example, a laser diffraction type particle size distribution analyzer.

The colorant content within the aggregated particles is preferably no greater than 50 wt %, and more preferably within the range from 2 to 20 wt %.

As the release agent to be used in the preferred toner manufacturing method, the same release agents as those describe above may be employed.

The average particle size of the release agent within the release agent dispersed liquid is preferably no greater than 1.5 μm, and more preferably within the range from 0.1 μm to 1 μm. When the average release agent particle size exceeds 1.5 μm, toner performance and reliability may become degraded because the particle size distribution of the resulting electrostatic latent image developing toner particles may become wide, and, in addition, free particles may be generated in the toner.

In the present toner manufacturing method, fine particles such as the above-described internal additives, charge control agents, inorganic fine particles, organic fine particles, lubricants, and polishing agents can be added, in accordance with necessity, to the above-described resin fine particle dispersed liquid, colorant dispersed liquid, release agent dispersed liquid, and the like. The addition of the fine particles may be performed by allowing those fine particles to be dispersed in the individual resin fine particle dispersed liquid, colorant dispersed liquid, and release agent dispersed liquid. Alternatively, the addition of the fine particles may be performed by first preparing a dispersion liquid having the fine particles dispersed therein, and adding the prepared dispersion liquid to a mixture of the binder resin particle dispersed liquid, colorant dispersed liquid, and release agent dispersed liquid.

The average particle size of the fine particles such as the internal additives, charge control agents, inorganic fine particles, organic fine particles, lubricants, and polishing agents is preferably no greater than 1 μm, and more preferably within the range from 0.01 μm to 1 μm. When the average particle size exceeds 1 μm, toner performance and reliability may become degraded because the particle size distribution of the resulting electrostatic latent image developing toner particles may become wide, and, in addition, free particles may be generated in the toner. In the present toner manufacturing method, by controlling the average particle size of the internal additives, charge control agents, inorganic fine particles, organic fine particles, lubricants, and polishing agents within the above-noted range, maldistribution of components among the individual toner particles can be prevented, thereby advantageously minimizing variances in toner performance and reliability. It should be noted that the average particle size can be measured using, for example, a laser diffraction type particle size distribution analyzer or a centrifugation type particle size distribution analyzer.

Before performing the aggregation process, a dispersion liquid can be prepared using the materials described above. The dispersion liquid includes at least a resin fine particle dispersed liquid, colorant dispersed liquid, and release agent dispersed liquid, and further includes other components added and mixed therein in accordance with necessity. The aggregation process can be performed by heating this dispersion liquid, while mixing, from room temperature to a temperature approximately 5° C. higher than the glass transition temperature of the resin. By this process, the resin fine particles, colorant, and the like can be aggregated to form aggregate particles.

During the aggregation process, the particles within the mixture containing the resin fine particle dispersed liquid, colorant dispersed liquid, and release agent dispersed liquid can be aggregated to form aggregate particles. The aggregate particles may be formed by hetero-aggregation. During this process, in order to stabilize the aggregate particles or to control particle size and particle size distribution or the like, it may be desirable to add an ionic surfactant having a polarity opposite from that of the aggregate particles or a compound having one or more than one valence charge such as a metal salt.

During the aggregation process, control of the aggregate particle size can be performed by causing a change in pH value to allow aggregate particle formation to occur in a desired manner. Further, it may be desirable to add a flocculant in order to achieve stable and speedy aggregation and to obtain aggregate particles having a narrow particle size distribution.

As the flocculant, a compound having a valence charge of one or more is preferably used. Specific examples include, without limitation, aqueous surfactants such as ionic surfactants and non-ionic surfactants; acids such as hydrochloric acid, sulfuric acid, nitric acid, acetic acid, and oxalic acid; metal salts of inorganic acids, such as magnesium chloride, sodium chloride, aluminum sulfate, calcium sulfate, ammonium sulfate, aluminum nitrate, silver nitrate, copper sulfate, and sodium carbonate; metal salts of aromatic acids and aliphatic acids, such as sodium acetate, potassium formate, sodium oxalate, sodium phthalate, and potassium salicylate; phenol-based metal salts such as sodium phenolate; and inorganic acid salts of aromatic amines and aliphatic amines, such as triethanolamine hydrochloride and aniline hydrochloride.

Among the above examples, the more preferred flocculants are metal salts of inorganic acids, such as magnesium chloride, sodium chloride, aluminum sulfate, calcium sulfate, ammonium sulfate, aluminum nitrate, silver nitrate, copper sulfate, and sodium carbonate; and inorganic and organic metal salts of aromatic acids and aliphatic acids, such as sodium acetate, potassium formate, sodium oxalate, sodium phthalate, and potassium salicylate. It is further preferred to use multivalent inorganic salts such as aluminum sulfate, aluminum nitrate, aluminum chloride, and magnesium chloride, because of the ability of these substances to achieve stability of the aggregated particles, the stability of these substances with respect to heat and passage of time, and the removability of these substances during the cleansing process.

The adding amount of the flocculant depends on the valence charge value of the flocculant, but is preferably small in any case. The adding amount of the flocculant in relation to the resin fine particles is preferably no greater than approximately 3 wt % for a monovalent flocculant, no greater than approximately 1 wt % for a divalent flocculant, and no greater than approximately 0.5 wt % for a trivalent flocculant. Because use of a smaller amount of flocculant is more preferable, it is desirable to employ a compound having a high valence value.

The volume average particle size of the flocculant particles is preferably within the range from 1 μm to 4.5 μm.

During the subsequent fusing process, the resin particles within the aggregate particles are melted at a temperature higher than or equal to the glass transition temperature of the binder resin, and more preferably at a temperature higher than or equal to a value 1.6 times greater than the glass transition temperature. As a result, the shapes of the resin particles would gradually change from non-uniform shapes to spherical shapes. The shapes of the aggregate particles may be initially non-uniform, but would become spherical as a result of coalescence. At the point when a desired value of shape factor SF1 is achieved, the heating of the toner can be ceased, and the cooling step can be performed to allow the toner particles to form. The material obtained as a result of the cooling can be atoner particle containing liquid (toner particle dispersed liquid) The cooling step is preferably performed at a cooling rate of 10° C./minute or faster to a temperature below a value that is 1.4 times greater than the glass transition temperature of the resin. Subsequently, the obtained toner particle containing liquid can be processed by centrifugation or vacuum filtration, so as to separate the toner particles. It may be desirable to cleanse the separated toner particles one to three times using ion-exchanged water. The cleansing effect can be enhanced by adjusting the pH during the cleansing. The toner particles can be then filtered for classification, washed one to three times using ion-exchanged water, and dried, so as to obtain the toner in its final form.

Between the aggregation process and the fusing process described above, it is possible to additionally perform an attaching process, in which a fine particle dispersed liquid having fine particles dispersed therein is added and mixed into the aggregate particle dispersed liquid. In this manner, the fine particles can be attached to the aggregate particles to thereby form aggregate particles with attachment.

During the attachment process, the fine particle dispersed liquid can be added and mixed into the aggregate particle dispersed liquid which was prepared by the aggregation process, to thereby attach the fine particles to the aggregate particles to form aggregate particles with attachment. Because the fine particles to be attached are those newly added to the aggregate particles, those fine particles may also be referred to as "additional fine particles". The additional fine particles may contain, for example, resin fine particles combined with single or multiple types of fine particles such as release agent fine particles and colorant fine particles. There exist no particular limitations concerning the method for adding and mixing the fine particle dispersed liquid. The adding and mixing may be performed in a gradual and continuous manner, or alternatively, in a stepwise process by dividing the process into a plural steps. By adding and mixing the fine particles (additional fine particles) as described above, generation of excessively small particles in the toner can be prevented. In this manner, particle size distribution of the resulting electrostatic latent image developing toner can be made narrow, contributing to production of high-quality images.

Furthermore, by performing the attaching process, a pseudo shell structure can be formed, which would minimize exposure of the internal additives such as the colorant and the release agent to the toner surface. As a result, the toner charging property and the carrier life can be improved. Performing of the attaching process is also advantageous in the following points. During the subsequent fusing process, a desired particle size distribution can be maintained, and fluctuations in the particle size distribution can be minimized. In addition, the necessity to add a surfactant or a basic or acidic stabilizer for enhancing stability during fusing can be eliminated, or the necessary adding amount of such chemicals can be reduced to a minimum level. As a result, cost reductions and quality improvements can be achieved. According to the present toner manufacturing method, because a release agent is employed as a toner material, it is particularly preferable to perform the attaching process using additional fine particles mainly composed of resin fine particles. By carrying out the attachment process in this manner, toner shape can be easily controlled during the fusing process by adjusting factors such as temperature, agitation rate, and pH.

According to the present toner manufacturing method, the various resin powders and inorganic compounds described above may be added on the toner particle surface, in the form of external additive, as a fluidity improver.

The electrostatic latent image developing toner manufactured by the present toner manufacturing method includes a binder resin, a colorant, and a release agent. The toner is characterized in that the shape factor SF1 of the toner is within the range from 110 to 140, the volume average particle size of the toner is within the range from 1.2 μm to 4.8 μm, and the crystallinity of the release agent within the toner is within the range from 35 to 80.

In the present toner manufacturing method, the crystallinity of the release agent within the toner is controlled. Accordingly, even when the toner is formed to have small particle size so as to achieve image quality enhancements, the toner can allow to accomplish high OHP transparency and long-term image stability. The toner can have stable charging property, fluidity, and storage stability.

(Electrostatic Latent Image Developer)

An electrostatic latent image developing toner according to the present embodiment can be fabricated by appropriately selecting materials and composition in accordance with intended use. The toner can be used alone as a single-component developer, or combined with a carrier to be used as a two-component developer. With the present embodiment, in order to achieve high processing speed, the toner is preferably used as a two-component developer which is compatible to high-speed processing.

There exist no particular limitations concerning the carrier to be used in the present embodiment, and any conventional carrier may be employed. As one example of the carrier, a resin-coated carrier will next be described. The core particles (core material) of the carrier maybe shaped particles of typical iron powder, ferrite, and magnetite. The volume average particle size D50v of those particles is preferably within the range from 30 μm to 200 μm.

Examples of resins for coating the core particles include, without limitation, styrenes such as styrene, para-chloro styrene, and α-methyl styrene; α-methylene fatty acid monocarboxylates such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, and 2-ethylhexyl methacrylate; nitrogen-containing acrylics such as dimethylaminoethyl methacrylate; vinyl nitriles such as acrylonitrile and methacrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone, and vinyl isopropenyl ketone; olephins such as ethylene and propylene; vinyl-based fluorine-containing monomers such as vinylidene fluoride, tetrafluoroethylene, and hexafluoroethylene; homopolymers thereof, or copolymers in which two or more monomers described above are combined; silicones such as methyl silicone and methyl phenyl silicone; polyesters containing bisphenol, glycol, and the like; epoxy resin; polyurethane resin; polyamide resin; cellulose resin; polyether resin; and polycarbonate resin.

The above-described resins can be used as a single entity or as a combination. The amount of use of the coating resin is preferably within the range between 0.1 to 10 parts by weight with respect to 100 parts by weight of the core particles, and more preferably within the range between 0.5 to 3 parts by weight.

The carriers may be fabricated using devices such as a heated kneader, heated Henschel mixer, and UM mixer. Depending on the amount of the coating resin used, it may be possible to use a heated flow or roll bed or a heated kiln. According to the developer of the present embodiment, the mixture ratio between the toner and the carrier is not particularly limited, and may be selected appropriately in accordance with intended use.

(Image Formation Method)

An image formation method using an electrostatic latent image developing toner of the present embodiment preferably includes a step of producing an electrostatic latent image on a surface of an electrostatic latent image carrier, a step of developing the electrostatic latent image on the electrostatic latent image carrier using an electrostatic latent image developer including the toner so as to form a toner image, a step of transferring the toner image onto a surface of a recording medium, and a step of fixing the toner image using heat. Each of those steps themselves are conventional steps, as described for example in Japanese Patent Laid- Open Publication No. Sho 56-40868 and Japanese Patent Laid-Open Publication No. Sho 49-91231. The steps as described in those publications can be favorably applied to implementation of the present invention. The present image formation method according to the present embodiment can be performed using a conventional image forming apparatus such as a copy machine and a facsimile machine. The step of transferring the toner image onto a receiver may be performed by directly transferring the toner image formed on the electrostatic latent image carrier onto the recording medium, or alternatively, by transferring the toner image via an intermediate transfer medium onto the recording medium.

According to the present image formation method, a conventional fixation device can be employed as the fixation device used with the electrostatic latent image developing toner. It is preferable to provide a release layer on the heating member of the fixation device. In order to effectively prevent toner adhesion, the release layer is preferably composed of a material having favorable releasability with respect to the toner, such as silicone rubber and fluorine-based resins. Preferred examples of the fluorine-based resins include, without limitation, copolymer of tetrafluoroethylene and perfluoroalkylvinylether, copolymer of tetrafluoroethylene and ethylene, and copolymer of tetrafluoroethylene and hexafluoroethylene. The thickness of the release layer can be appropriately selected in accordance with intended use, but is preferably within the range from 10 μm to 60 μm.

Because the toner contains a release agent according to the present configuration, it is unnecessary to apply a release liquid such as silicone oil on the heating member. However, for the purpose of ensuring a high temperature fixation region, such a release liquid may be used by an amount of no greater than 1μL per A4-sized sheet.

EXAMPLES

The present invention will next be described in further detail using examples and comparative examples. It should be noted that the present invention is not limited by the examples below.

Explanation will first be made concerning the toners used in the examples and the comparative examples. The term "parts" as used hereinafter signifies "parts by weight".

The method for analyzing particle size distribution as used in the present examples involves employing a Coulter counter Model TA-II (manufactured by Beckman Coulter, Inc.) as the measuring apparatus, and electrolyte ISOTON-II (manufactured by Beckman Coulter, Inc.). In this measurement method, 0.5 mg to 50 mg of a sample to be measured is added to 2 mL of an aqueous solution containing 5% surfactant, which is preferably sodium alkylbenzenesulfonate, serving as a dispersant. This mixture is added to 100 mL to 150 mL of the above-noted electrolyte. The resulting sample-suspended electrolyte is subjected to dispersion processing for approximately one minute using an ultrasonic dispersion device. Subsequently, the Coulter counter Model TA-II is employed, while setting the aperture diameter to 30 μm, to measure the particle size distribution of particles having sizes from 0.6 μm to 18 μm within the electrolyte, so as to determine the volume average distribution and the number average distribution. The number of measured particles is 5000. Based on the determined volume average distribution and number average distribution, a volume average particle size and a number average particle size are obtained.

An average particle size distribution GSD is given by the following equation:

$$GSD=[(d16/d84)]^{0.5} \quad \text{(Equation II)}$$

In this equation, volume d16 denotes a particle size where an accumulated volume in an accumulation distribution from larger size reaches 16% and volume d84 denotes a particle size where the accumulated volume in the accumulation distribution from larger size reaches 84%. The values of d16, and d84 are therefore such that the inequality of d16>d84 holds true. A smaller GSD value indicates that the particle sizes of the toner are more uniform. While GSD can be calculated based on either the number average particle size or the volume average particle size, the GSD values referred to in the present specification are based on volume average particle sizes.

In the examples, the average particle sizes of the resin fine particles, colorant fine particles, and release agent fine particles are measured using a laser diffraction type particle size distribution analyzer model LA-700 (manufactured by HORIBA Ltd.).

Distribution analysis concerning a certain molecular weight is performed under the following conditions. As the GPC device, GPC model HLC-8120GPC in combination with system controller SC-8020 (manufactured by Tosoh Corporation) is used, along with two columns of "TSK gel Super HM-H" (6.0 mm ID×15 cm; manufactured by Tosoh Corporation). In addition, THF (tetrahydrofuran) is used as the eluate. Experimental conditions are as below: sample concentration is 0.5%; flow rate is 0.6 mL/min.; sample injection amount is 10 μL; measurement temperature is 40° C.; and an IR detector is employed. Calibration curves are determined using ten samples of polystyrene standard samples "TSK standard" models A-500, F-1, F-10, F-80, F-380, A-2500, F-4, F-40, F-128, and F-700 (manufactured by Tosoh Corporation).

Glass transition temperature of resin particles is measured using a differential scanning calorimeter DSC-50 (manufactured by Shimadzu Corporation) under the temperature increase rate of 3° C./minute.

Crystallinity of a release agent within a toner is measured by dissolving the toner in THF, recovering the insoluble wax component and analyzing the recovered wax using an X-ray diffractometer Geigerflex RAD X (manufactured by RIGAKU Corporation) under the following conditions:

X-ray: Cu—K α ray

Wavelength λ: 1.54 angstroms

Output: 40 kV, 40 mA

Optical system: reflection method; slits DS, SS=1°; RS=0.3 mm

Measured range: 2θ=10° to 35°

Step interval: 0.02°

Scan rate: 2θ/θ continuous scan 1.00°/minute

In the obtained X-ray diffraction profile, crystal peaks and non-crystalline scattering regions are identified, and based on areas of each of those regions, crystallinity is calculated as below:

$$\text{Crystallinity}(\%)=[Ic/(Ic+Ia)]\cdot 100$$

wherein Ic=sum of areas of crystal peaks, and Ia=sum of areas of non-crystalline scattering regions.

After toner fabrication, release agent domain size is confirmed by observing cross-sections of 200 particles using a transmission electron microscope device model JEM-1010 type electron microscope (manufactured by JEOL, Ltd.). The average length of the major axis of domains is employed as the domain size value.

Toner shape factor SF1 is an average of shape factor values given by (square of maximum length/projected area), and can be determined by the following method. An optical microscopic image of a toner sprayed on a slide glass is input via a video camera into a LUZEX image analyzer. In the analyzer, the values of (square of maximum length/projected area; $ML^2/A$) are calculated for more than 50 particles of the toner, and an average of those values is determined.

The following various dispersion liquids are first prepared. <Preparation of Resin Fine Particle Dispersed Liquid (1)>

Materials:

| | |
|---|---|
| Styrene | 350 parts |
| Butyl acrylate | 50 parts |
| Acrylic acid | 8 parts |
| Dodecyl mercaptan | 10 parts |
| Carbon tetrabromide | 3 parts |

The above components are mixed and dissolved to prepare a preliminary solution. A surfactant solution obtained by dissolving, in 520 parts of ion-exchanged water, 7 parts of non-ionic surfactant NOVONYL (manufactured by Sanyo Chemical Industries, Ltd.) and 10 parts of anionic surfactant NEOGEN R (manufactured by Daiichi-kogyo Seiyaku Co., Ltd.) are introduced in a flask together with the preliminary solution. The content of the flask is mechanically dispersed and emulsified using a pressure dispersion apparatus Gaulin homogenizer (distributed by Doei Shoji Co.). While slowly mixing for 10 minutes, a solution obtained by dissolving 3 parts of ammonium persulfate in 70 parts of ion-exchanged water is added to the emulsion to perform nitrogen substitution. Subsequently, while mixing, the flask is heated in an oil bath until the temperature of the flask content reached 70° C. This emulsion polymerization process is continued for six hours. After that, the reaction liquid is cooled to room temperature. The resulting resin dispersed liquid (1) have the average particle size of 148 nm, the glass transition temperature of 51.2° C., the weight average molecular weight Mw of 21000, and Mw/Mn of 2.5.

<Preparation of Resin Fine Particle Dispersed Liquid (2)>

Materials:

| | |
|---|---|
| Styrene | 280 parts |
| n-butyl acrylate | 100 parts |
| Acrylic acid | 8 parts |
| Dodecane thiol | 10 parts |
| Carbon tetrabromide | 3 parts |

The above components are mixed together and dissolved to prepare a preliminary solution. A surfactant solution obtained by dissolving, in 520 parts of ion-exchanged water, 10 parts of non-ionic surfactant NOVONYL (manufactured by Sanyo Chemical Industries, Ltd.) and 6 parts of anionic surfactant NEOGEN RK (manufactured by Daiichi-kogyo Seiyaku Co., Ltd.) are introduced in a flask together with the preliminary solution. The content of the flask is mechanically dispersed and emulsified using a homogenizer ULTRA-TURRAX (manufactured by IKA). While slowly mixing for 10 minutes, a solution obtained by dissolving 3 parts of ammonium persulfate in 70 parts of ion-exchanged water is added to the emulsion to perform nitrogen substitution. Subsequently, while mixing, the flask is heated in an oil bath until the temperature of the flask content reached 70° C. This emulsion polymerization process is continued for six hours. After that, the reaction liquid is cooled to room temperature. The resulting resin dispersed liquid (2) have the average particle size of 160 nm, the glass transition temperature of 58.6° C., the weight average molecular weight of 26000, and Mw/Mn of 2.3.

<Preparation of Colorant Dispersed Liquid (1)>

Materials:

| | |
|---|---|
| Phthalocyanine pigment PVFASTBLUE (Dainichiseika Color & Chemicals Mfg. Co., Ltd.) | 70 parts |
| Anionic surfactant (manufactured by Wako Pure Chemical Industries, Ltd.) | 3 parts |
| Ion-exchanged water | 400 parts |

After the above components are mixed together and dissolved, the solution is dispersed using a homogenizer ULTRA-TURRAX (manufactured by IKA). The resulting colorant dispersed liquid (1) contain a colorant (phthalocyanine pigment) having the average particle size of 150 nm dispersed therein.

<Preparation of Release Agent Dispersed Liquid (1)>

Materials:

| | |
|---|---|
| Polyethylene wax (melting point = 109° C.; crystallinity = 67) | 100 parts |
| Anionic surfactant PYONIN A-45-D (manufactured by Takemoto Oil & Fat Co., Ltd.) | 2 parts |
| Ion-exchanged water | 500 parts |

After the above components are mixed together and dissolved, the solution is dispersed using a homogenizer ULTRA-TURRAX (manufactured by IKA), and further subjected to dispersion processing by a pressure injection type homogenizer. The resulting release agent dispersed liquid (1) contain release agent particles (polyethylene wax) having the average particle size of 280 nm dispersed therein.

<Preparation of Release Agent Dispersed Liquid (2)>

Materials:

| | |
|---|---|
| Polypropylene wax (melting point = 152° C.; crystallinity = 58) | 100 parts |
| Anionic surfactant PYONIN A-45-D (manufactured by Takemoto Oil & Fat Co., Ltd.) | 2 parts |
| Ion-exchanged water | 500 parts |

After the above components are mixed together and dissolved, the solution is dispersed using a homogenizer ULTRA-TURRAX (manufactured by IKA), and further subjected to dispersion processing by a pressure injection type homogenizer. The resulting release agent dispersed liquid (2) contain release agent particles (polypropylene wax) having the average particle size of 270 nm dispersed therein.

<Preparation of Release Agent Dispersed Liquid (3)>

Materials:

| | |
|---|---|
| Polyethylene wax<br>(melting point = 108° C.; crystallinity = 77) | 100 parts |
| Anionic surfactant PYONIN A-45-D<br>(manufactured by Takemoto Oil & Fat Co., Ltd.) | 2 parts |
| Ion-exchanged water | 500 parts |

After the above components are mixed together and dissolved, the solution is dispersed using a homogenizer ULTRA-TURRAX (manufactured by IKA), and further subjected to dispersion processing by a pressure injection type homogenizer. The resulting release agent dispersed liquid (3) contain release agent particles (polyethylene wax) having the average particle size of 280 nm dispersed therein.

<Preparation of Release Agent Dispersed Liquid (4)>

Materials:

| | |
|---|---|
| Carnauba wax<br>(melting point = 101° C.; crystallinity = 31) | 100 parts |
| Anionic surfactant PYONIN A-45-D<br>(manufactured by Takemoto Oil & Fat Co., Ltd.) | 2 parts |
| Ion-exchanged water | 500 parts |

After the above components are mixed together and dissolved, the solution is dispersed using a homogenizer ULTRA-TURRAX (manufactured by IKA), and further subjected to dispersion processing by a pressure injection type homogenizer. The resulting release agent dispersed liquid (4) contain release agent particles (carnauba wax) having the average particle size of 260 nm dispersed therein.

<Preparation of Release Agent Dispersed Liquid (5)>

Materials:

| | |
|---|---|
| Polypropylene wax<br>(melting point = 120° C.; crystallinity = 38) | 100 parts |
| Anionic surfactant PYONIN A-45-D<br>(manufactured by Takemoto Oil & Fat Co., Ltd.) | 2 parts |
| Ion-exchanged water | 500 parts |

After the above components are mixed together and dissolved, the solution is dispersed using a homogenizer ULTRA-TURRAX (manufactured by IKA), and further subjected to dispersion processing by a pressure injection type homogenizer. The resulting release agent dispersed liquid (5) contain release agent particles (polypropylene wax) having the average particle size of 230 nm dispersed therein.

<Preparation of Release Agent Dispersed Liquid (6)>

Materials:

| | |
|---|---|
| Polypropylene wax<br>(melting point = 114° C.; crystallinity = 75) | 100 parts |
| Anionic surfactant PYONIN A-45-D<br>(manufactured by Takemoto Oil & Fat Co., Ltd.) | 2 parts |
| Ion-exchanged water | 500 parts |

After the above components are mixed together and dissolved, the solution is dispersed using a homogenizer ULTRA-TURRAX (manufactured by IKA), and further subjected to dispersion processing by a pressure injection type homogenizer. The resulting release agent dispersed liquid (6) contain release agent particles (polypropylene wax) having the average particle size of 267 nm dispersed therein.

Example 1

<Preparation of Toner A>

Materials:

| | |
|---|---|
| Resin dispersed liquid (1) | 300 parts |
| Colorant dispersed liquid (1) | 200 parts |
| Release agent dispersed liquid (1)<br>(corresponding to 16.7 wt % of the toner) | 100 parts |
| Cationic surfactant SANISOL B50<br>(manufactured by Kao Corporation) | 3 parts |
| Ion-exchanged water | 500 parts |

The above components are mixed and dispersed within a stainless steel round bottom flask using a homogenizer ULTRA-TURRAX T50 (manufactured by IKA). The dispersed material is then heated in a heating oil bath to 50° C. while mixing, and maintained at 50° C. for 30 minutes to form aggregate particles. An observation of a portion of the obtained aggregate particles using an optical microscope reveal that the average particle size of the aggregate particles is approximately 3.5 μm. Into this aggregate particle liquid, additional 30 parts of resin dispersed liquid (1) are added gradually. This mixture is further heated while mixing at 50° C. for 30 minutes to obtain aggregate particle liquid (A). An observation of the obtained aggregate particle liquid using an optical microscope reveal that the average aggregate particle size is approximately 4.2 μm.

Subsequently, into the obtained dispersion liquid, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to allow the aggregate particles to fuse. Next, 700 parts of ion-exchanged water at 10° C. are added to cool the product to 50° C. in 1.5 minutes. The obtained particles are then filtered and sufficiently washed with ion-exchanged water, and further filtered using a 400 mesh sieve. Using a Coulter counter, the volume average particle size D50v of the fused particles is determined as 4.3 μm. The fused particles are dried using a vacuum drier to obtain toner A having the shape factor SF1 of 121.

An observation of the cross-section of the above toner A using a transmission electron microscope (TEM) device reveal that the domain size of the release agent is 1.8 μm. Moreover, crystallinity of the release agent within the toner is 69% according to X-ray diffraction analysis.

<Preparation of Developer A>

3.3 parts of colloidal silica (R972 manufactured by Nippon Aerosil Co., Ltd.) are added to 100 parts of toner A prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 45 μm. The resulting mixture is mixed for 5 minutes in a ball mill to obtain developer A.

<Image Formation and Evaluation>

Using the obtained developer A, a toner image having a weight of 3.5 mg/cm$^2$ is formed on an OHP film (XEROX FILM manufactured by Fuji Xerox Office Supply) by employing a modified version of DocuCentre Color400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Transparency (haze value) of the fixed image is determined using a haze meter (direct-reading haze computer HGM-2DP manufactured by Suga Test Instruments Co., Ltd.). A haze value less than or equal to 35 is evaluated as "good", while a haze value greater than 35 is evaluated as "bad". Further, a running test is performed by printing a black image on 20000 sheets of recording paper (J paper manufactured by Fuji Xerox Office Supply), so as to confirm image stability. The results are as shown in Table 1 below.

Example 2

<Preparation of Toner B>

Materials:

| | |
|---|---|
| Resin dispersed liquid (2) | 300 parts |
| Colorant dispersed liquid (1) | 200 parts |
| Release agent dispersed liquid (2) (corresponding to 19.3 wt % of the toner) | 120 parts |
| Cationic surfactant SANISOL B50 (manufactured by Kao Corporation) | 3 parts |
| Ion-exchanged water | 500 parts |

The above components are mixed and dispersed within a stainless steel round bottom flask using a homogenizer ULTRA-TURRAX T50 (manufactured by IKA). The dispersed material is then heated in a heating oil bath to 50° C. while mixing, and maintained at 50° C. for 30 minutes to form aggregate particles. An observation of a portion of the obtained aggregate particles using an optical microscope reveal that the average particle size of the aggregate particles is approximately 2.8 μm. Into this aggregate particle liquid, additional 30 parts of resin dispersed liquid (2) are added gradually. This mixture is further heated while mixing at 50° C. for 30 minutes to obtain aggregate particle liquid (B). An observation of the obtained aggregate particle liquid using an optical microscope reveal that the average aggregate particle size is approximately 3.6 μm.

Subsequently, into the obtained dispersion liquid, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to fuse the aggregate particles. Next, 600 parts of ion-exchanged water at 10° C. are added to cool the product to 54° C. in 3 minutes. The obtained particles are then filtered and sufficiently washed with ion-exchanged water, and further filtered using a 400 mesh sieve. Using a Coulter counter, the volume average particle size D50v of the fused particles is determined as 3.6 μm. The fused particles are dried using a vacuum drier to obtain toner B having the shape factor SF1 of 126.

An observation of the cross-section of the above toner B using a TEM device reveal that the domain size of the release agent is 1.9 μm. Moreover, crystallinity of the release agent within the toner is 62% according to X-ray diffraction analysis.

<Preparation of Developer B>

3.7 parts of colloidal silica (R972 manufactured by Nippon Aerosil Co., Ltd.) are added to 100 parts of toner B prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer B.

In the same manner as in the above-described Example 1, using the obtained developer B, a toner image having a weight of 3.5 mg/cm$^2$ is formed on an OHP film (XEROX FILM manufactured by Fuji Xerox Office Supply) by employing a modified version of DocuCentre Color 400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Example 3

Into the aggregate particle liquid (B) obtained as describe in Example 2, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to fuse the aggregate particles. Next, 300 parts of dry ice are added to cool the product to 78° C. in 1.2 minutes. The obtained particles are then filtered and sufficiently washed with ion-exchanged water, and further filtered using a sieve of 400 mesh. Using a Coulter counter, the volume average particle size D50v of the fused particles is determined as 3.8 μm. The fused particles are dried using a vacuum drier to obtain toner C having the shape factor SF1 of 123.

An observation of the cross-section of the above toner C using a TEM device reveal that the domain size of the release agent is 1.1 μm. Moreover, crystallinity of the release agent within the toner is 61% according to X-ray diffraction analysis.

<Preparation of Developer C>

3.7 parts of colloidal silica (R972 manufactured by Nippon Aerosil Co., Ltd.) are added to 100 parts of toner C prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer C.

In the same manner as in the above-described Example 1, using the obtained developer C, a toner image having a weight of 3.5 mg/cm$^2$ is formed on an OHP film (XEROX FILM manufactured by Fuji Xerox Office Supply) by employing a modified version of DocuCentre Color 400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Example 4

Into the aggregate particle liquid (B) obtained as describe in Example 2, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to fuse the aggregate particles. Next, 800 parts of ice water having the ice-to-water weight ratio of 1:9 and the temperature of 0° C. are added to cool the product to 42° C. in 2 minutes. The obtained particles are then filtered and sufficiently washed with ion-exchanged water, and further filtered using a sieve of 400 mesh. Using a Coulter counter, the volume average particle size D50v of the fused particles is determined as 3.3 μm. The fused particles are dried using a vacuum drier to obtain toner D having the shape factor SF1 of 120.

An observation of the cross-section of the above toner D using a TEM device reveal that the domain size of the release agent is 1.6 μm. Moreover, crystallinity of the release agent within the toner is 61% according to X-ray diffraction analysis.

<Preparation of Developer D>

3.7 parts of colloidal silica (R972 manufactured by Nippon Aerosil Co., Ltd.) are added to 100 parts of toner D prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer D.

In the same manner as in the above-described Example 1, using the obtained developer D, a toner image having a weight of 3.5 mg/cm$^2$ is formed on an OHP film (XEROX FILM manufactured by Fuji Xerox Office Supply) by employing a modified version of DocuCentre Color 400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Example 5

<Preparation of Toner E>

Materials:

| | |
|---|---|
| Resin dispersed liquid (1) | 300 parts |
| Colorant dispersed liquid (1) | 200 parts |
| Release agent dispersed liquid (5) (corresponding to 16.7 wt % of the toner) | 100 parts |
| Cationic surfactant SANISOL B50 (manufactured by Kao Corporation) | 3 parts |
| Ion-exchanged water | 500 parts |

The above components are mixed and dispersed within a stainless steel round bottom flask using a homogenizer ULTRA-TURRAX T50 (manufactured by IKA). The dispersed material is then heated in a heating oil bath to 50° C. while mixing, and maintained at 50° C. for 30 minutes to form aggregate particles. An observation of a portion of the obtained aggregate particles using an optical microscope reveal that the average particle size of the aggregate particles is approximately 3.3 μm. Into this aggregate particle liquid, additional 30 parts of resin dispersed liquid (1) are added gradually. This mixture is further heated while mixing at 50° C. for 30 minutes to obtain aggregate particle liquid (E). An observation of the obtained aggregate particle liquid using an optical microscope reveal that the average aggregate particle size is approximately 3.8 μm.

Subsequently, into the obtained dispersion liquid, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to fuse the aggregate particles. Next, 600 parts of ion-exchanged water at 10° C. are added to cool the product to 54° C. in 3 minutes. The obtained particles are then filtered and sufficiently washed with ion-exchanged water, and further filtered using a 400 mesh sieve. Using a Coulter counter, the volume average particle size D50v of the fused particles is determined as 3.7 μm. The fused particles are dried using a vacuum drier to obtain toner E having the shape factor SF1 of 121.

An observation of the cross-section of the above toner B using a TEM device reveal that the domain size of the release agent is 1.2 μm. Moreover, crystallinity of the release agent within the toner is 44% according to X-ray diffraction analysis.

<Preparation of Developer E>

3.7 parts of colloidal silica (R972 manufactured by Nippon Aerosil Co., Ltd.) are added to 100 parts of toner E prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer E.

In the same manner as in the above-described Example 1, using the obtained developer E, a toner image having a weight of 3.5 mg/cm$^2$ is formed on an OHP film (XEROX FILM manufactured by Fuji Xerox Office Supply) by employing a modified version of DocuCentere Color 400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Example 6

<Preparation of Toner F>

Materials:

| | |
|---|---|
| Resin dispersed liquid (1) | 300 parts |
| Colorant dispersed liquid (1) | 200 parts |
| Release agent dispersed liquid (6) (corresponding to 16.7 wt % of the toner) | 100 parts |
| Cationic surfactant SANISOL B-50 (manufactured by Kao Corporation) | 3 parts |
| Ion-exchanged water | 500 parts |

The above components are mixed and dispersed within a stainless steel round bottom flask using a homogenizer ULTRA-TURRAX T50 (manufactured by IKA). The dispersed material is then heated in a heating oil bath to 50° C. while mixing, and maintained at 50° C. for 30 minutes to form aggregate particles. An observation of a portion of the obtained aggregate particles using an optical microscope reveal that the average particle size of the aggregate particles is approximately 2.9 μm. Into this aggregate particle liquid, additional 30 parts of resin dispersed liquid (1) are added gradually. This mixture is further heated while mixing at 50° C. for 30 minutes to obtain aggregate particle liquid (F). An observation of the obtained aggregate particle liquid using an optical microscope reveal that the average aggregate particle size is approximately 3.8 μm.

Subsequently, into the obtained dispersion liquid, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to fuse the aggregate particles. Next, 600 parts of ion-exchanged water at 10° C. are added to cool the product to 55° C. in 3 minutes. The obtained particles are then filtered and sufficiently washed with ion-exchanged water, and further filtered using a 400 mesh sieve. Using a Coulter counter, the volume average particle size D50v of the fused particles is determined as 3.6 μm. The fused particles are dried using a vacuum drier to obtain toner F having the shape factor SF1 of 119.

An observation of the cross-section of the above toner F using a TEM device reveal that the domain size of the release agent is 1.1 μm. Moreover, crystallinity of the release agent within the toner is 78% according to X-ray diffraction analysis.

<Preparation of Developer F>

3.7 parts of colloidal silica (R972 manufactured by Nippon Aerosil Co., Ltd.) are added to 100 parts of toner F prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer F.

In the same manner as in the above-described Example 1, using the obtained developer F, a toner image having a weight of 3.5 mg/cm$^2$ is formed on an OHP film (XEROX FILM manufactured by Fuji Xerox Office Supply) by employing a modified version of DocuCentre Color 400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Comparative Example 1

<Preparation of Toner G>

Materials:

| | |
|---|---|
| Resin dispersed liquid (1) | 300 parts |
| Colorant dispersed liquid (1) | 200 parts |
| Release agent dispersed liquid (3) (corresponding to 16.7 wt % of the toner) | 100 parts |
| Cationic surfactant SANISOL B-50 (manufactured by Kao Corporation) | 3 parts |
| Ion-exchanged water | 500 parts |

The above components are mixed and dispersed within a stainless steel round bottom flask using a homogenizer ULTRA-TURRAX T50 (manufactured by IKA). The dispersed material is then heated in a heating oil bath to 50° C. while mixing, and maintained at 50° C. for 30 minutes to form aggregate particles. An observation of a portion of the obtained aggregate particles using an optical microscope reveal that the average particle size of the aggregate particles is approximately 3.6 μm. Into this aggregate particle liquid, additional 30 parts of resin dispersed liquid (1) are added gradually. This mixture is further heated while mixing at 50° C. for 30 minutes to obtain aggregate particle liquid (G). An observation of the obtained aggregate particle liquid using an optical microscope reveal that the average aggregate particle size is approximately 4.2 μm.

Subsequently, into the obtained dispersion liquid, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 7 hours to fuse the aggregate particles. Next, 200 parts of ion-exchanged water at 10° C. are added while cooling with a cooling jacket employing well water at 18° C., so as to cool the product to 52° C. in 10 minutes. The obtained particles are then filtered and sufficiently washed with ion-exchanged water, and further filtered using a 400 mesh sieve. Using a Coulter counter, the volume average particle size D50v of the fused particles is determined as 4.1 μm. The fused particles are dried using a vacuum drier to obtain toner G having the shape factor SF1 of 143.

An observation of the cross-section of the above toner G using a TEM device reveal that the domain size of the release agent is 2.7 μm. Moreover, crystallinity of the release agent within the toner is 84% according to X-ray diffraction analysis.

<Preparation of Developer G>

3.7 parts of colloidal silica (R972 manufactured by Nippon Aerosil Co., Ltd.) are added to 100 parts of toner G prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer G.

In the same manner as in the above-described Example 1, using the obtained developer G, a toner image having a weight of 3.5 mg/cm$^2$ is formed on an OHP film (XEROX FILM manufactured by Fuji Xerox Office Supply) by employing a modified version of DocuCentre Color400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Comparative Example 2

<Preparation of Toner H>

Materials:

| | |
|---|---|
| Resin dispersed liquid (1) | 300 parts |
| Colorant dispersed liquid (1) | 200 parts |
| Release agent dispersed liquid (4) (corresponding to 16.7 wt % of the toner) | 100 parts |
| Cationic surfactant SANISOL B-50 (manufactured by Kao Corporation) | 3 parts |
| Ion-exchanged water | 500 parts |

The above components are mixed and dispersed within a stainless steel round bottom flask using a homogenizer ULTRA-TURRAX T50 (manufactured by IKA). The dispersed material is then heated in a heating oil bath to 50° C. while mixing, and maintained at 50° C. for 30 minutes to form aggregate particles. An observation of a portion of the obtained aggregate particles using an optical microscope reveal that the average particle size of the aggregate particles is approximately 2.8 μm. Into this aggregate particle liquid, additional 30 parts of resin dispersed liquid (1) are added gradually. This mixture is further heated while mixing at 50° C. for 30 minutes to obtain aggregate particle liquid (H). An observation of the obtained aggregate particle liquid using an optical microscope reveal that the average aggregate particle size is approximately 3.7 μm.

Subsequently, into the obtained dispersion liquid, 6 parts of anionic surfactant sodium dodecylbenzenesufonate (NEOGEN SC manufactured by Daiichi-kogyo Seiyaku Co., Ltd.) are added. The mixture is heated to 97° C. and maintained at that temperature for 5 hours to fuse the aggregate particles. Next, 700 parts of ion-exchanged water at 10° C. are added to cool the product to 52° C. in 4 minutes. The obtained particles are then filtered and sufficiently washed with ion-exchanged water, and further filtered using a 400 mesh sieve. Using a Coulter counter, the volume average particle size D50v of the fused particles is determined as 3.7 μm. The fused particles are dried using a vacuum drier to obtain toner H having the shape factor SF1 of 136.

An observation of the cross-section of the above toner H using a TEM device reveal that the domain size of the release agent is 0.7 μm. Moreover, crystallinity of the release agent within the toner is 32% according to X-ray diffraction analysis.

<Preparation of Developer H>

3.7 parts of colloidal silica (R972 manufactured by Nippon Aerosil Co., Ltd.) are added to 100 parts of toner H prepared as described above, and the mixture is mixed using a Henschel mixer to obtain an electrostatic latent image developing toner. Subsequently, the obtained toner is metered (5 wt % of the carrier) into a glass bottle along with a ferrite carrier coated with 1 wt % polymethyl methacrylate (manufactured by Soken Chemical and Engineering Co., Ltd.) and having the volume average particle size D50v of 50 μm. The resulting mixture is mixed for 5 minutes in a ball mill to obtain developer H.

In the same manner as in the above-described Example 1, using the obtained developer H, a toner image having a weight of 3.5 mg/cm$^2$ is formed on an OHP film (XEROX FILM manufactured by Fuji Xerox Office Supply) by employing a modified version of DocuCentre Color400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

Comparative Example 3

Toner I is prepared in the same manner as in Example 1 except that the cooling step is performed using a cooling jacket employing ion-exchanged water at 18° C., so as to cool the product to 52° C. in 5 minutes. The volume average particle size D50v of the fused particles is 4.2 μm, and the shape factor SF1 is 144.

An observation of the cross-section of the above toner I using a TEM device reveal that the domain size of the release agent is 2.7 μm. Moreover, crystallinity of the release agent within the toner is 79% according to X-ray diffraction analysis.

<Preparation of Developer I>

3.7 parts of colloidal silica (R972 manufactured by Nippon Aerosil Co., Ltd.) are added to 100 parts of toner I prepared as described above, and the mixture is mixed using a Henschel mixer to obtain an electrostatic latent image developing toner. Subsequently, the obtained toner is metered into a glass bottle along with a ferrite carrier coated with 1 wt % polymethyl methacrylate (manufactured by Soken Chemical and Engineering Co., Ltd.) and having the volume average particle size D50v of 50 μm, such that the toner concentration became 5 wt %. The resulting mixture is mixed for 5 minutes in a ball mill to obtain developer I.

In the same manner as in the above-described Example 1, using the obtained developer I, a toner image having a weight of 3.5 mg/cm$^2$ is formed on an OHP film (XEROX FILM manufactured by Fuji Xerox Office Supply) by employing a modified version of DocuCentre Color400 device (the fixation structure contained a heat roll and a belt, and the nip width is 16 mm) in which the toner weight per unit area is adjusted to 18.0 mg/cm$^2$ during the image forming process. The image is fixed by adjusting the fixation temperature to 180° C. and the processing speed to 180 mm/second. Further, as in Example 1, haze value of the fixed image is determined, and image stability is confirmed by printing a black image on recording paper sheets (J paper manufactured by Fuji Xerox Office Supply).

The entire disclosure of Japanese Patent Application No. 2004-17918 filed on Jan. 27, 2004 including specification, claims and abstract is incorporated herein by reference in its entirety.

TABLE 1

| | Crystallinity of release agent within toner (%) | Resin Tg (° C.) | Fusing Temperature (° C.) | Cooling Temperature (° C.) | Cooling rate (° C./min) | SF1 | R/D ratio | Haze value | Image stability |
|---|---|---|---|---|---|---|---|---|---|
| Example 1 | 69 | 51.2 | 97 | 50 | 31.3 | 121 | 0.42 | 24 (good) | No problem up to 20000 sheets |
| Example 2 | 62 | 58.6 | 97 | 54 | 14.3 | 126 | 0.53 | 30 (good) | No problem up to 20000 sheets |
| Example 3 | 61 | 58.6 | 97 | 78 | 15.8 | 123 | 0.29 | 31 (good) | No problem up to 20000 sheets |
| Example 4 | 61 | 58.6 | 97 | 42 | 27.5 | 120 | 0.48 | 30 (good) | No problem up to 20000 sheets |
| Example 5 | 44 | 51.2 | 97 | 54 | 14.3 | 121 | 0.32 | 33 (good) | No problem up to 20000 sheets |
| Example 6 | 78 | 51.2 | 97 | 55 | 14.0 | 119 | 0.31 | 26 (good) | No problem up to 20000 sheets |
| Comparative example 1 | 84 | 51.2 | 97 | 52 | 4.5 | 143 | 0.66 | 38 (bad) | Carrier adhesion occurred after 4000 sheets |
| Comparative example 2 | 32 | 51.2 | 97 | 52 | 11.2 | 136 | 0.19 | 52 (bad) | No problem up to 20000 sheets |
| Comparative example 3 | 79 | 51.2 | 97 | 52 | 9.0 | 144 | 0.64 | 33 (good) | Carrier adhesion occurred after 3000 sheets |

What is claimed is:

1. An electrostatic latent image developing toner including a binder resin, a colorant, and a release agent, wherein:

shape factor SF1 of the toner is within a range from 110 to 140, where $SF1=(ML^2/A)\cdot(\pi/4)\cdot 100$, ML denoting an absolute maximum length of a toner particle and A denoting a projected area of a toner particle;

volume average particle size of the toner is within a range from 1.2 pm to 4.8 μm;

crystallinity of the release agent within the toner is within a range from 35 to 80; and R/D is within a range from 0.2 to 0.6, where R denotes a domain average longitudinal diameter of the release agent within the toner and D denotes the volume average particle size of the toner.

2. An electrostatic latent image developing toner as defined in claim 1, wherein the crystallinity is within a range from 40 to 75.

3. An electrostatic latent image developing toner as defined in claim 1, wherein the crystallinity is within a range from 50 to 70.

4. An electrostatic latent image developing toner as defined in claim 1, wherein particle size distribution GSD of the toner is no greater than 1.26, where $GSD=[(d16/d84)]^{0.5}$, volume d16 denotes a particle size where an accumulated volume in an accumulation distribution from larger size reaches 16% and volume d84 denotes a particle size where the accumulated volume in the accumulation distribution from larger size reaches 84%.

5. An electrostatic latent image developing toner as defined in claim 1, wherein glass transition temperature of the binder resin is within a range from 40° C. to 70° C.

6. An electrostatic latent image developing toner as defined in claim 1, wherein weight average molecular weight Mw of the binder resin is within a range from 6000 to 45000.

7. An electrostatic latent image developing toner as defined in claim 1, wherein the binder resin is a vinyl-based resin.

8. An electrostatic latent image developing toner as defined in claim 1, wherein content of the release agent within the toner is within a range of 6 to 25 wt % of the toner weight.

9. An electrostatic latent image developing toner as defined in claim 1, wherein the shape factor SF1 of the toner is within a range from 115 to 135.

10. An electrostatic latent image developing toner as defined in claim 1, wherein the shape factor SF1 of the toner is within a range from 115 to 130.

11. An electrostatic latent image developing toner as defined in claim 1, wherein the volume average particle size of the toner is within a range from 2.0 μm to 4.5 μm.

12. An electrostatic latent image developing toner as defined in claim 1, wherein the volume average particle size of the toner is within a range from 2.5 μm to 4.0 μm.

13. An electrostatic latent image developer comprising an electrostatic latent image developing toner including a binder resin, a colorant, and a release agent, wherein: shape factor SF1 of the toner is within a range from 110 to 140, where $SF1=(ML^2/A)\cdot(\pi/4)\cdot 100$, ML denoting an absolute maximum length of a toner particle and A denoting a projected area of a toner particle;

volume average particle size of the toner is within a range from 1.2 μm to 4.8 μm;

crystallinity of the release agent within the toner is within a range from 35 to 80; and R/D is within a range from 0.2 to 0.6, where R denotes a domain average longitudinal diameter of the release agent within the toner and D denotes the volume average particle size of the toner.

14. A method for manufacturing an electrostatic latent image developing toner including a binder resin, a colorant, and a release agent, the method comprising a process of granulating particles of the toner, the granulating process including:

a step of heating to or above glass transition temperature of the binder resin; and a step of cooling performed after the heating step by speedily cooling at a cooling rate of 10°C./minute or faster from the temperature of the heating step, wherein:

the toner obtained as a result of the granulating process is such that:

shape factor SF1 of the toner is within a range from 110 to 140, where $SF1=(ML^2/A)\cdot(\pi/4)\cdot 100$, ML denoting an absolute maximum length of a toner particle and A denoting a projected area of a toner particle;

volume average particle size of the toner is within a range from 1.2 μm to 4.8 μm;

crystallinity of the release agent within the toner is within a range from 35 to 80; and R/D is within a range from 0.2 to 0.6, where R denotes a domain average longitudinal diameter of the release agent within the toner and D denotes the volume average particle size of the toner.

15. A method for manufacturing an electrostatic latent image developing toner as defined in claim 14, wherein the cooling step includes adding, into a tank in which the granulating process is performed, a cooled solvent or a solid obtained by cooling and solidifying the solvent.

16. A method for manufacturing an electrostatic latent image developing toner as defined in claim 14, wherein the cooling step includes adding, into a tank in which the granulating process is performed, a liquid or solid form of a cooling substance that is in gas phase at room temperatures.

17. A method for manufacturing an electrostatic latent image developing toner as defined in claim 14, wherein the heating step includes heating to or above a temperature value that is 1.6 times greater than the glass transition temperature of the binder resin, and the cooling step includes cooling, after the heating step, to a temperature below a value that is 1.4 times greater than the glass transition temperature of the binder resin.

18. A method for manufacturing an electrostatic latent image developing toner as defined in claim 17, wherein the cooling step includes adding, into a tank in which the granulating process is performed, a cooled solvent or a solid obtained by cooling and solidifying the solvent.

19. A method for manufacturing an electrostatic latent image developing toner as defined in claim 17, wherein the cooling step includes adding, into a tank in which the granulating process is performed, a liquid or solid form of a cooling substance that is in gas phase at room temperatures.

* * * * *